US006059487A

United States Patent [19]

Haga et al.

[11] Patent Number: 6,059,487

[45] Date of Patent: May 9, 2000

[54] VEHICLE BARRIER SYSTEM

[75] Inventors: Charles T. Haga, Woodland Hills; Bryan J. Kudela, Catheys Valley, both of Calif.

[73] Assignee: Malibu Entertainment Worldwide, Inc., Dallas, Tex.

[21] Appl. No.: 09/026,861

[22] Filed: Feb. 20, 1998

[51] Int. Cl.[7] ..... E01F 13/00; E04H 17/00

[52] U.S. Cl. ..... 404/6; 256/13.1

[58] Field of Search ..... 404/6; 256/13.1, 256/1

[56] References Cited

U.S. PATENT DOCUMENTS

| | | | |
|---|---|---|---|
| 1,931,904 | 10/1933 | Pehrson | 256/13.1 |
| 3,385,565 | 5/1968 | Cuthbert . | |
| 3,447,786 | 6/1969 | Bigni . | |
| 3,602,109 | 8/1971 | Harrington | 256/13.1 |
| 3,690,619 | 9/1972 | Kendall | 256/13.1 |
| 4,090,694 | 5/1978 | Vincent | 256/13.1 |
| 4,662,611 | 5/1987 | Ruane | 256/13.1 |
| 4,681,302 | 7/1987 | Thompson | 256/13.1 |
| 4,806,044 | 2/1989 | Duckett | 404/6 |
| 4,828,425 | 5/1989 | Duckett | 404/6 |
| 5,006,008 | 4/1991 | Bishop | 404/6 |
| 5,007,763 | 4/1991 | Burgett | 404/6 |
| 5,074,704 | 12/1991 | McKay | 404/6 |
| 5,123,773 | 6/1992 | Yodock | 404/6 |
| 5,259,154 | 11/1993 | Lilley | 47/33 |
| 5,597,262 | 1/1997 | Beavers et al. | 404/6 |
| 5,688,071 | 11/1997 | Owen | 404/6 |

*Primary Examiner*—Eileen Dunn Lillis
*Assistant Examiner*—Raymond W. Addie
*Attorney, Agent, or Firm*—Marc A. Hubbard; Munsch Hardt Kopf & Harr, P.C.

[57] ABSTRACT

A barrier vehicle system for an amusement race track is formed from a chain of pivotally coupled barrier modules. Each barrier module has a top and a bottom link separated by a spacer structurally joined with the top and bottom links to create a rigid structure when assembled. A pin extends through the top and bottom links, to one side of the spacer. An resilient, deformable barrel is journalled on the pin. To assist in attenuating high energy impacts, an extendable, energy-absorbing mechanism is attached to one end of the barrier, and the other end of the barrier is anchored to the ground.

15 Claims, 7 Drawing Sheets

VEHICLE BARRIER SYSTEM

FIELD OF INVENTION

The invention pertains generally to barrier systems for vehicles and the like.

BACKGROUND OF INVENTION

Barrier systems are used in a number of applications for blocking or redirecting movement of vehicles and similar objects, and, in the process of doing so, absorbing some amount of the vehicle's kinetic energy. There are numerous examples of barrier systems—for example, steel guard rails, concrete wall dividers, arrays of barrels and plastic shells filled with water or sand. Steel guard rails and concrete wall dividers are intended primarily to redirect a vehicle, such as away from oncoming traffic or from perils along side a road, not to absorb much of the kinetic energy of a moving vehicle upon impact. Thus, they tend to be used where head-on impacts are unlikely. Furthermore, they are very strong and withstand impacts. It is the vehicle that tends to absorb the brunt of the impact with such a barrier. On the other hand, barrel arrays and water-filled plastic shells are intended to permanently deform in order to absorb substantial amounts of kinetic energy, especially in a progressive manner in order to slow a vehicle to a stop without causing mortal injury to the occupants of the vehicle. They are used in situations where head-on impacts are more likely, especially where there exists obstructions such as bridge embankments and pillars that would cause significant damage to a vehicle hitting it. Both the vehicle and the barrier suffer significant damage during impact.

During impacts involving relatively high kinetic energies, these types of barriers or the vehicles, or both, tend to be permanently damaged. Generally, all such barriers tend to rely on the vehicle to absorb some of the energy, primarily through deformation. Indeed, during lower speed impacts, it is the vehicle that is intended to suffer most of the damage, primarily through deformation. Consequently, these barriers are acceptable for roads and highways since automobiles are not expected to frequently impact them. However, in situations where impacts are much more likely, either more resilient systems or less expensively and more quickly repaired systems are desirable.

An example of one such situation is a go-kart track, especially one used for amusement rather than sport racing purposes. Barriers traditionally used on roads are generally unacceptable for use on such amusement tracks. Amusement-type go-kart tracks, especially the type featuring many turns, require resilient systems that will absorb a significant amount of kinetic energy of the vehicle at lower speeds. Patrons of amusement parks will tend to crash into barriers more frequently. Damage to the vehicle and the barrier is therefore to be avoided. Thus, the speed of the vehicles are kept somewhat low, and resilient barrier systems on the track and resilient bumper systems on the vehicles are used to absorb kinetic energy during impact with a barrier without damaging the vehicle or track. One example of such a resilient barrier system is a line of tires, or portions thereof, laid end-to-end around the track, flat against the ground. An exterior side of the tires abut a curb or other fixed vertical structure, or alternately, each of the tires is anchored to the ground. The tires act like springs, absorbing and, to some degree, dissipating kinetic energy while remaining resilient. To prevent a vehicle from grabbing a tire during a glancing impact, a thin band of steel or other material lines the inside edge of the tires, opposite the curb, to create a flexible steel wall against which vehicles may easily glance.

Such a system is acceptable for relatively low-velocity vehicles, especially where they cannot easily crash into a barrier head-on. However, newer amusement tracks desire to more closely simulate real racing experiences, using heavier vehicles that operate at higher speeds. Prior art systems tend not to exhibit desirable energy absorption characteristics: they are either not sufficiently elastic or sufficiently strong enough.

SUMMARY OF INVENTION

The invention pertains generally to a vehicle barrier system that provides enhanced strength and elasticity for absorbing greater energy during impacts without causing permanent damage to either the vehicle or the barrier, and enhanced properties for redirecting a vehicle during impact. Furthermore, it can be easily be assembled in the field from a few, basic, light-weight components. It can also be configured in almost any shape, and easily reconfigured or, in the case of impact, restored to its original position. Thus, it is well suited to amusing racing tracks, where it is able to be relatively easily laid out, restored and reconfigured.

A barrier system according to the present invention is formed from a plurality of barrier modules pivotally linked together to form a barrier chain. Each barrier module can be assembled from a few basic components. These components include an elastically or resiliently deformable barrel rotatably mounted between a pair of links. The barrel is journalled on a pin that extends between the pair of links. This same pin can be used to pivotally connect two modules by overlapping end portions of the links from the respective modules. Each module further includes a spacer between the pair of links. The spacer maintains separation between the links so that the barrel is free to rotate. Furthermore, the spacer is structurally joined with the top and bottom links to create a rigid structure when the module is assembled. The resulting structure thus tends to resist twisting. The chain of barrier modules may be anchored by one or more of the pins extending into bore holes in the ground or a footing.

To further enhance energy absorption of higher kinetic energy impacts, a barrier system according to the present invention may also include a chain comprised of a plurality of pivotally connected barrier modules connected at one end to an extendable, energy-absorbing mechanism, and anchored to the ground at another barrier module, with barrier modules between the end connected to the extendable, energy-absorbing mechanism and the anchor point free to slide on the ground. A vehicle impacting the chain at a point between the anchors will cause the chain to slide laterally across the ground, thereby transferring some of the kinetic energy of the vehicle to the extendable, energy absorbing mechanism as the barrier chain pulls on and extends the extendable, energy-absorbing mechanism.

The foregoing is intended only to briefly describe some of the aspects and technical advantages of the invention as exemplified by the embodiments described below. It is not intended in any way to limit the scope of the appended claims which define the invention.

BRIEF DESCRIPTION OF THE DRAWINGS

For a more complete understanding of the present invention, and the advantages thereof, reference is now made to the following description of a preferred embodiment for the invention taken in conjunction with the accompanying drawings, in which.

DETAILED DESCRIPTION OF A PREFERRED EMBODIMENT

In the following description, like numbers refer to like parts.

Figure 1:
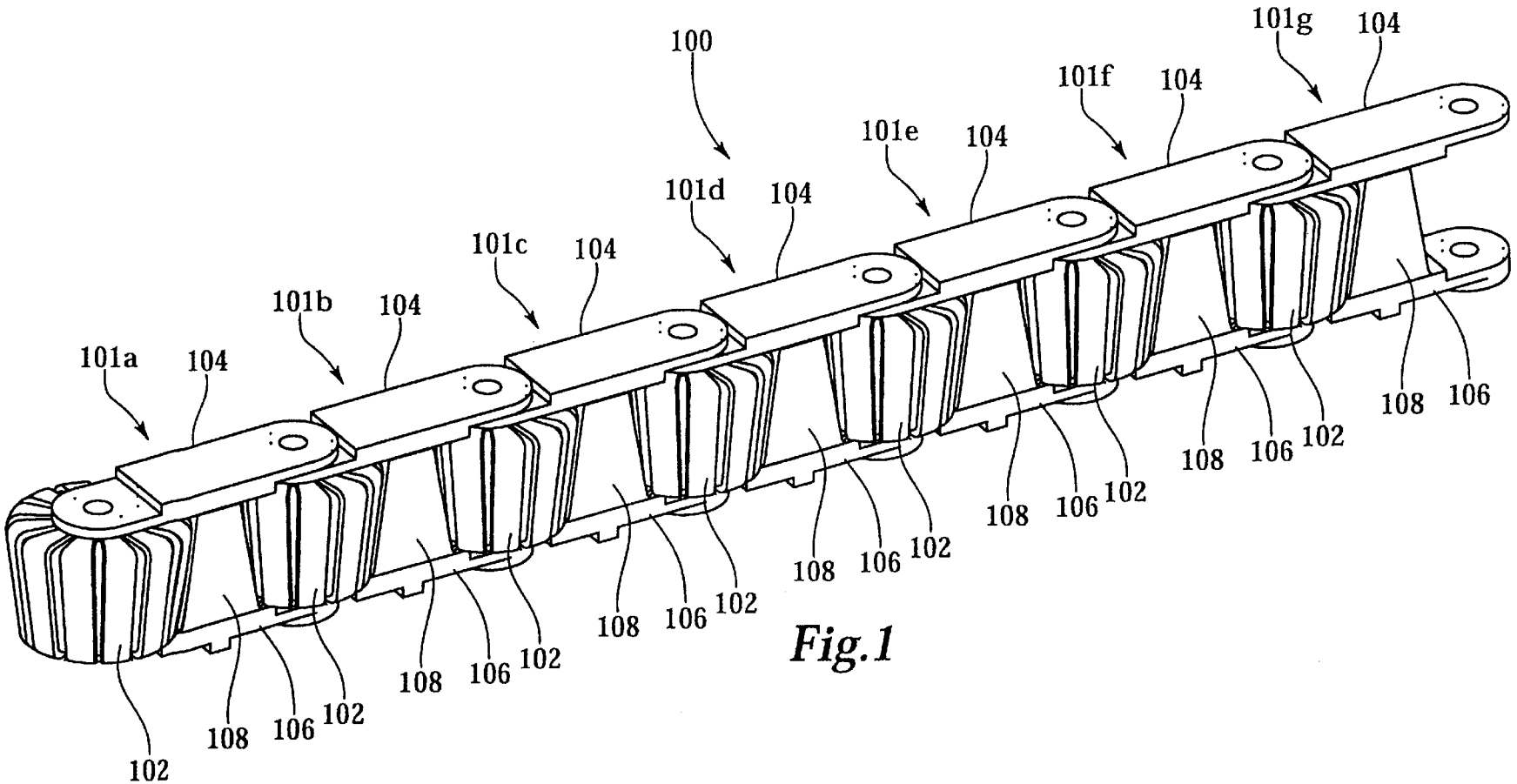
FIG. 1 is a perspective view of a barrier system comprised of a chain of barrier modules.
Figure 2:
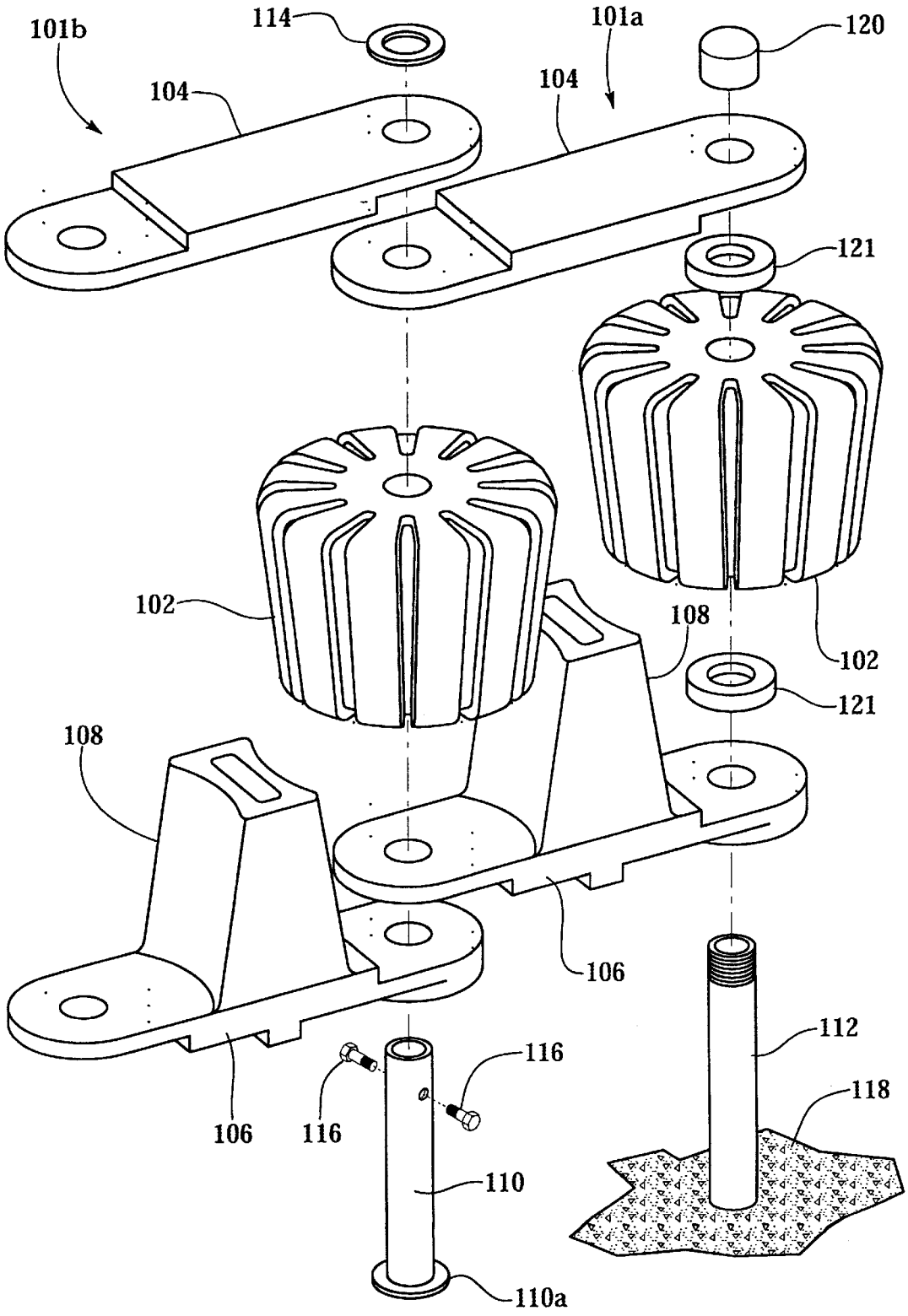
FIG. 2 is an exploded view of two modules from the barrier chain of FIG. 1.

Referring now to FIGS. 1 and 2, barrier chain 100 is formed from a chain of a plurality of barrier modules, referenced 101*a*, 101*b*, 101*c*, 101*d*, 101*e*, 101*f* and 101*g*, respectively, that are pivotally linked one-to-another.

Each barrier module is comprised of a rotating barrel 102, a top link 104, bottom link 106, and a spacer 108. The bottom link 106 and spacer 108 are, in the illustrated embodiment, integrally formed as a unitary member. The barrel is rotatably mounted on a pin, such as linking pin 110 or anchor pin 112, extending between the top and bottom links. Rotation of the barrel assists in redirecting a nose of a vehicle from its line of impact to a preferred direction. Adequate clearance between each barrel and the spacers and links adjacent to it ensure that the barrel is able to rotate when impacted, even when the barrel is significantly deformed. The spacer 108 maintains a predetermined distance between the links. The side of barrel 102 extends beyond the sides of the top link 104, bottom link 106 and the spacer 108 so that it is the portion of the barrier that receives the brunt of an impact.

The pin also joins one module to an adjacent module so that modules are able to pivot with respect to each other about the axis of the pin. In the preferred embodiment, the pin also holds together the assembled module. The linking pin 110 extends only from a bottom side of bottom link 106 to a top side of top link 104. It provides only an axle on which the barrel rotates and, if linking two modules, a link for pivotally connecting the two modules. Linking pin 110 includes a flange portion 110*a* that rests flat against the ground, under the bottom link 106. The flange cooperates with a retaining ring 114 held on the opposite end of the pin, on top of the top link, by set screws 116 to prevent the top and bottom links from separating under strain of an impact. Anchoring pin 112, on the other hand, extends below the bottom link and into a hole bored into or formed in the ground or a concrete footer 118. To prevent the module from riding up on the anchoring pin, a cap 120 is attached to a top end of the pin after the links and barrel are slid onto it. The pins 110 and 112 are easily inserted into, or removed from, the barrier modules, thus facilitating, at the point of deployment, assembly, repair and reconfiguration. Any one or all of the modules may be anchored using an anchoring pin, depending on the particular application. The pins are preferably made of either steel or PVC pipe. PVC is more elastic than steel, and thus provides extra cushioning during impact. A steel pipe or post provides a rigid pivot point for anchoring one end of a chain. Other materials could be used for different applications.

Figure 3:
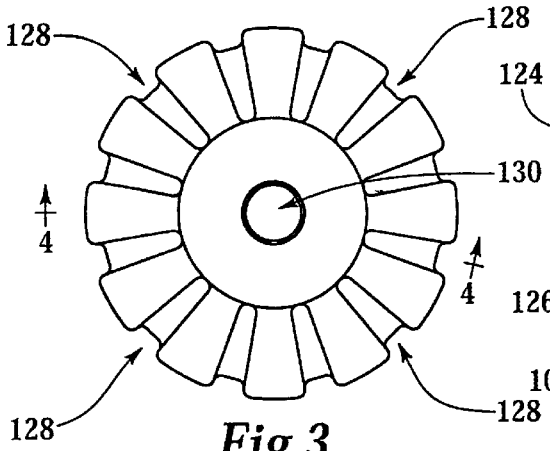
FIG. 3 is a top view of a barrel of a barrier module of FIG. 2.
Figure 4:
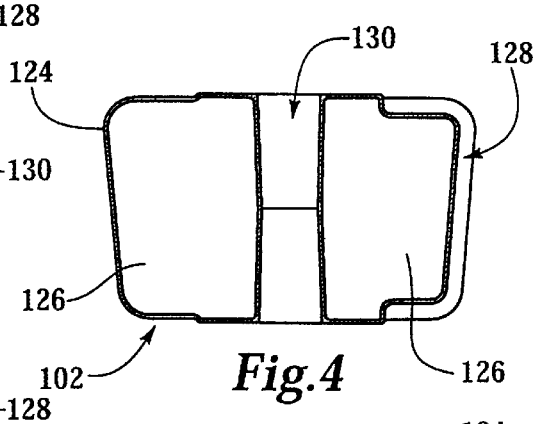
FIG. 4 is cross-section of barrier taken along section line 4—4 in FIG. 3.

Referring to FIGS. 3 and 4, each barrel 102 has fluted side walls 124 defining a hollow, internal cavity 126. The hollowness of the barrel contributes to the system's overall lightweight and ease of set-up, configuration and reconfiguration, and accommodates deformation of the side walls during impact in order to absorb energy. Flutes 128 reduce the surface area that can be contacted by a vehicle, and thus reduce the frictional force between a vehicle and the barrier. The fluting also structurally enhances the strength or resistance to compression of the side walls. The type of material and fluting determine the strength (the ability to withstand the impact) and elasticity (the ability to return to its original shape) of the barrel. The hollow cavity within a barrel could be filled with a material to add mass to the barrier, to provide greater rotational mass or resistance to spinning, or to strengthen its side walls. Baffles may also me inserted into the hollow cavity 126 to improve stiffness or dampening of movement of the fill material if required by the particular application. Each barrel includes a hub 130, formed by interior walls of the barrel, for journalling the barrel on pin 110 or 112. The side walls 124 of the barrel are tapered. When oriented with the taper increasing from the ground up, the side walls tend to resist a vehicle climbing up and possibly over the barrier chain. If oriented the opposite direction, so that the widest part of the barrel is nearest the ground, the barrel is able to absorb more energy during impact.

The material chosen for the barrel depends on the strength, cost and impact force attenuation that is desired for the particular application. One preferred material in an amusement racing track application is rotationally molded, crosslink polyethylene. This material is relatively low-cost and can be molded in bright colors for enhanced visibility and aesthetic attractiveness. It also possesses high impact strength and elasticity, and is capable of returning to its original shape after substantial deformation. A linear, low density polyethylene could also be used to reduce costs in applications where less strength and elasticity is required. Rubber materials could also be used, but they cost significantly more. Plastisol elastomers could also be used in low impact force applications, as well as vinyls, polycarbonates, polyurethanes and similar materials.

Figure 6:
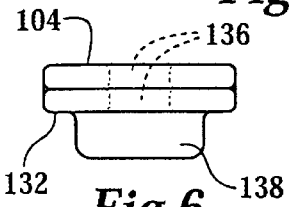
FIG. 6 is an end view of the top link of FIG. 5.
Figure 5:
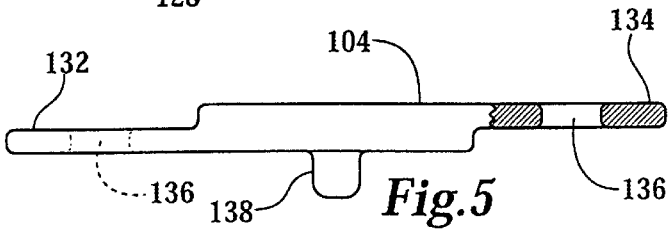
FIG. 5 is a side-view of a top link of a barrier module, partially sectioned along line 5—5 in FIG. 7.
Figure 7:
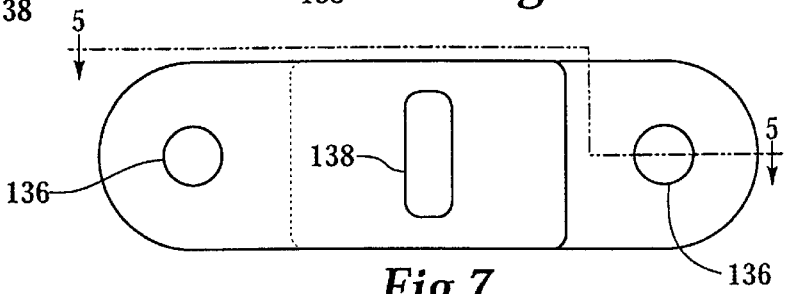
FIG. 7 is a bottom view of the top link of FIG. 5.

Referring now to FIGS. 5–7, the top link 104 is substantially flat. In order to accommodate end-to-end linking of top link 104 while maintaining all the barrels in a chain at the same height, as shown in FIGS. 1 and 2, end 132 of the link is stepped down and end 134 of the top link is stepped up. This allows end 120 to overlap the end 118 of an adjacent link in the manner shown in FIG. 2. Each of the ends 118 and 120 are rounded to accommodate pivoting of the link. An opening 136 is formed through each end for accommodating either the linking pin 110 or anchoring pin 112 (FIG. 2). An elongated bump 138 is formed on a bottom side of the top link for registering the top link with a complementary opening 140 (FIG. 8) formed in a top surface of spacer 108. This registration not only maintains proper alignment, but also strengthens the resulting structure to prevent relative lateral movement of the top and bottom links and spacer. Furthermore, the elongated shape of the bump 138 and opening 140 enhances the torsional strength or resistance to twisting of the structure.

Figure 8:
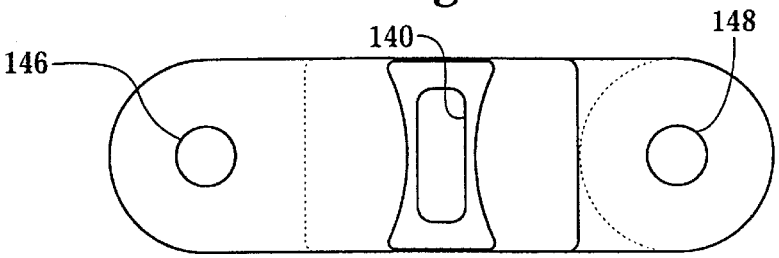
FIG. 8 is a top view of an integrally formed bottom link and spacer of a barrier module.
Figure 9:
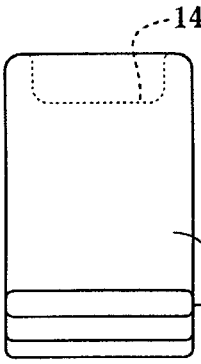
FIG. 9 is an end view of the integrally formed bottom link and spacer of FIG. 8.
Figure 10:
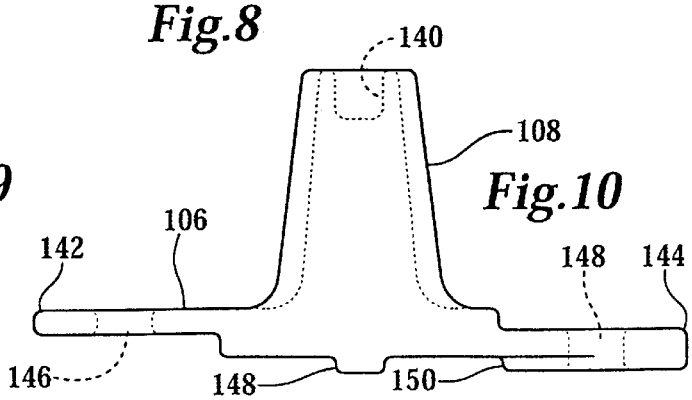
FIG. 10 is a side view of the integrally formed bottom link and spacer of FIG. 8.

Referring now to FIGS. 8, 9 and 10, as previously mentioned, the bottom link 106 and spacer 108 are integrally formed as a unitary member, such as by a molding process. Alternately, the bottom link 106 and spacer 108 could be formed as separate pieces and permanently joined, or, instead, the spacer and top link 104 and spacer could be integrally formed or permanently joined. The spacer enhances the rigidity of each barrier module. A rigid connection between the spacer and one of the links, as formed through integrally molding the spacer and link, provides a strong, rigid barrier structure that is resistant to twisting. End 142 of the bottom link is stepped up, and end 144 of the bottom link 106 is stepped down to fit under the end 142 of another bottom link. Openings 146 are formed in each end of the link, on opposite sides of spacer 108, to receive either linking pin 110 or anchoring pin 112 (FIG. 2). Formed on the bottom surface of the bottom link is a middle footing 148 and end footing 150 that rest against the ground and slightly elevate the barrier chain above the ground.

Figure 11:
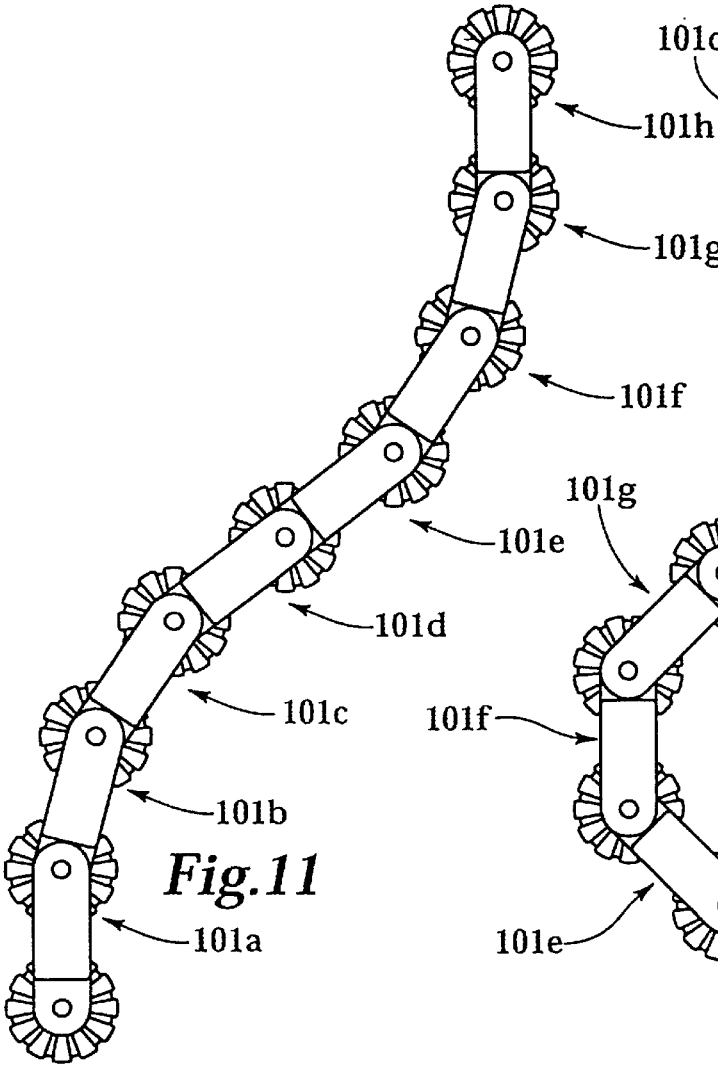
FIG. 11 is a plan view of a barrier chain arranged a curved line configuration.
Figure 12:
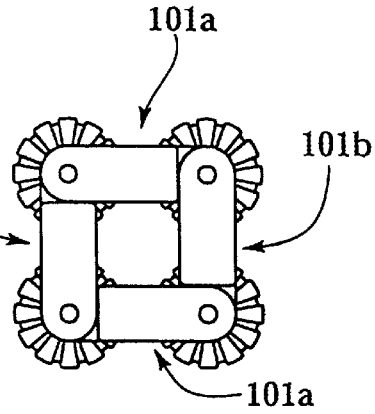
FIG. 12 is a plan view of a barrier chain arranged in a square configuration.
Figure 13:
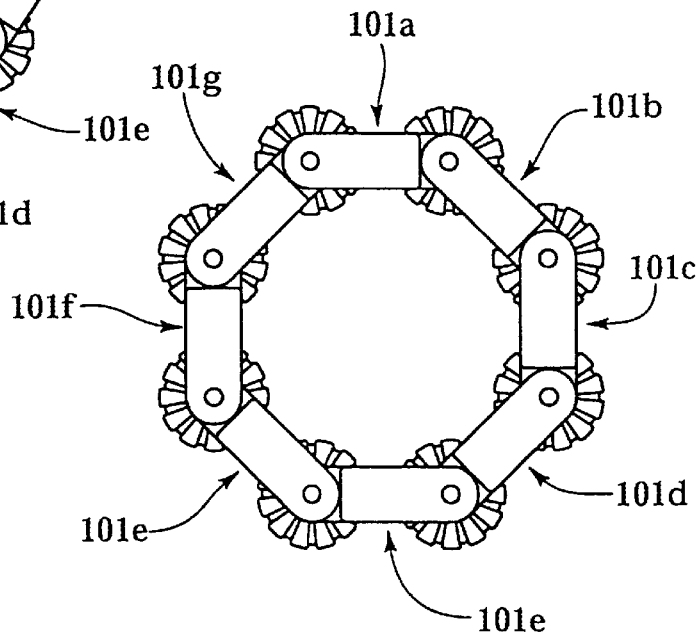
FIG. 13 is a plan view of a barrier chain arranged in an octagonal configuration.

Referring now to FIGS. 11, 12 and 13, a plurality of barrier modules 101 can assume almost any configuration. In FIG. 11, a plurality of barrier modules 101*a*–101*h* are chained together to form a single, curved line. In FIG. 12, a plurality of barrier modules 101*a*–101*d* are formed in a closed square, and in FIG. 13 a plurality of barrier modules 101*a*–101*g* are formed in a closed octagon. As previously mentioned, each module in a chain can either be anchored to the ground or floating.

Figure 14:
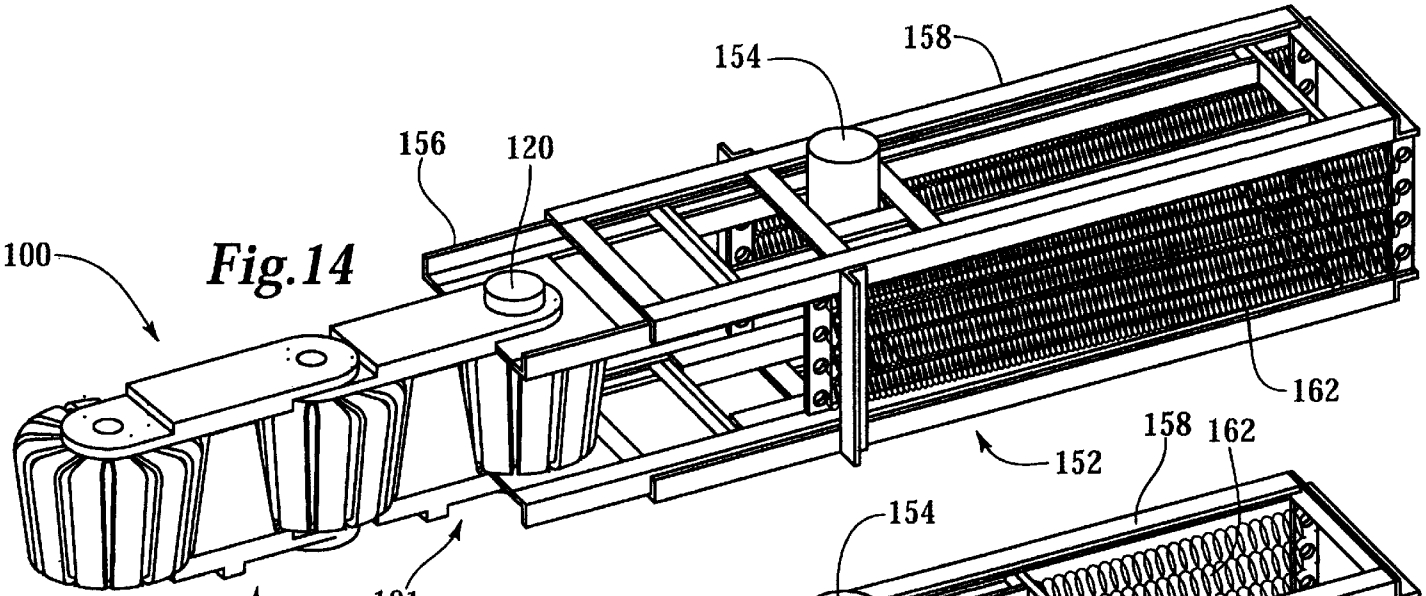
FIG. 14 is a perspective view of a barrier chain attached to an extendable, energy-absorbing mechanism in a fully retracted position.
Figure 15:
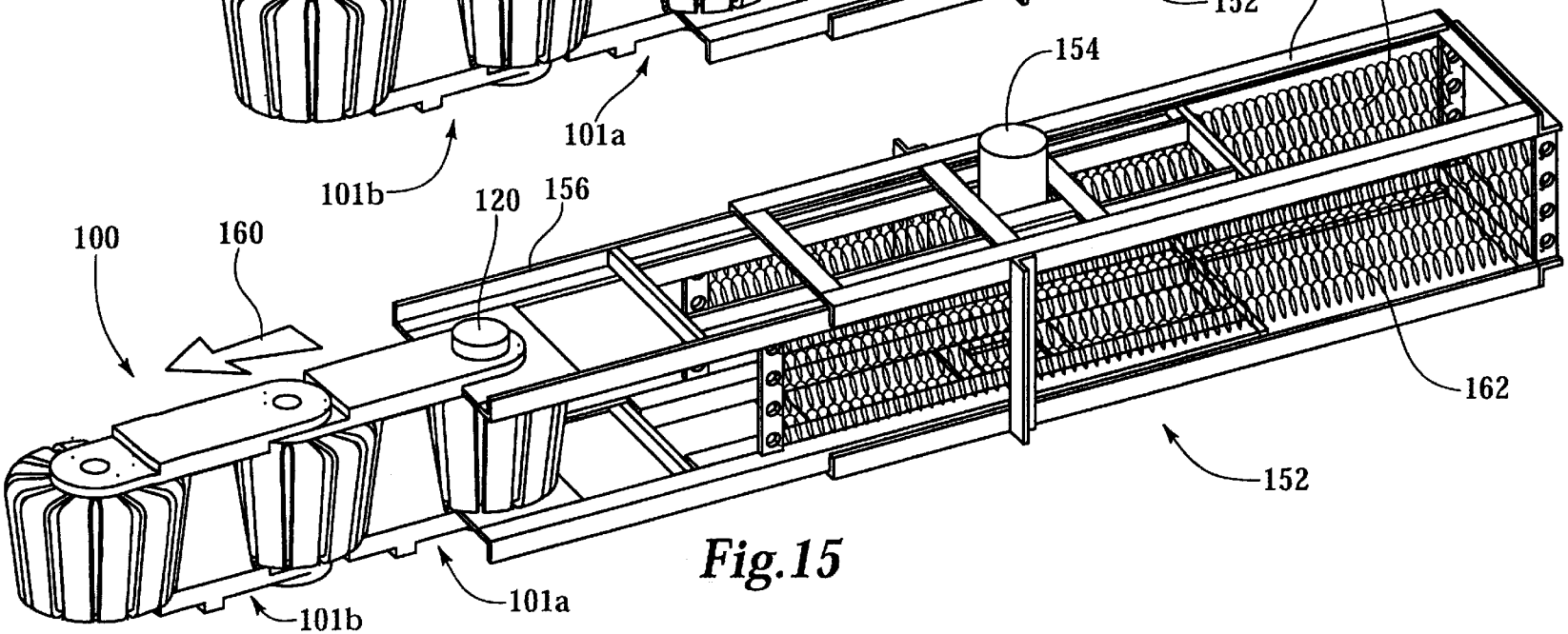
FIG. 15 is a perspective view of the barrier chain of FIG. 14 with the extendable, energy absorbing mechanism in an extended position.

Referring now to FIGS. 14–19, to provide enhanced energy absorption capacity and resiliency, a barrier chain 100, formed by a plurality of barrier modules 101*a*–101*l*, is anchored at one end to a post, and is connected at its other end to an extendable energy-absorbing mechanism, such as spring cage 152. (Note that only two modules, 101*a* and 101*b*, are shown in FIGS. 14 and 15.) One terminating end of the chain, namely the end of barrier module 101*a*, is attached to energy absorption mechanism, namely spring cage 152, which in turn is laterally anchored to a post 154. Post 154 is set in the ground or a footing. The other terminating end of the module, namely barrier module 101*l*, is anchored to a post set in the ground. Depending on the particular application, a barrier module intermediate the barrier modules at the ends of the barrier chain could, instead, be anchored to the ground. The remaining modules 101*b*–101*j* are not anchored and are free to slide across the ground. The spring cage 152 includes an inner cage 156, which slides within an outer cage 158. The inner cage includes a mounting at one end of it for pivotally connecting barrier module 101*a* using a linking pin 110. The outer cage is able to pivot about post 154. Coupled between the inner cage and the outer cage are energy absorbing components that function to absorb energy in response to movement of inner cage with respect to the outer cage due to forces pulling on barrier chain 100 in the direction of arrow 160.

Figure 19:
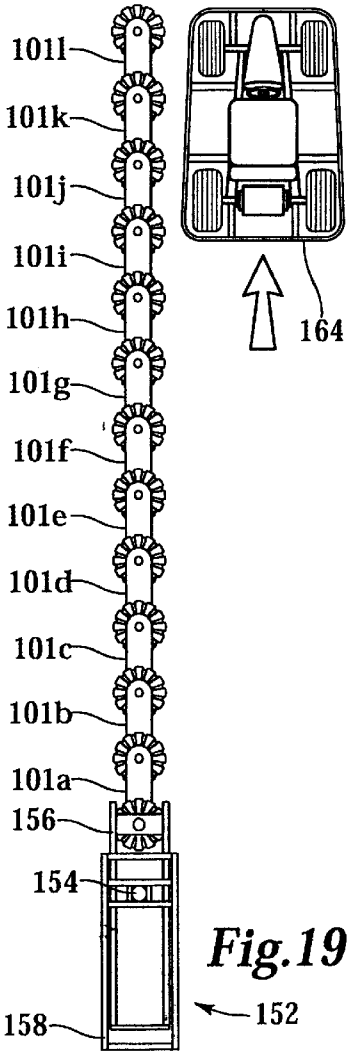
FIG. 19 is a plan view of the barrier chain of FIG. 16 after the vehicle returns to the track and the barrier chain retracts.
Figure 18:
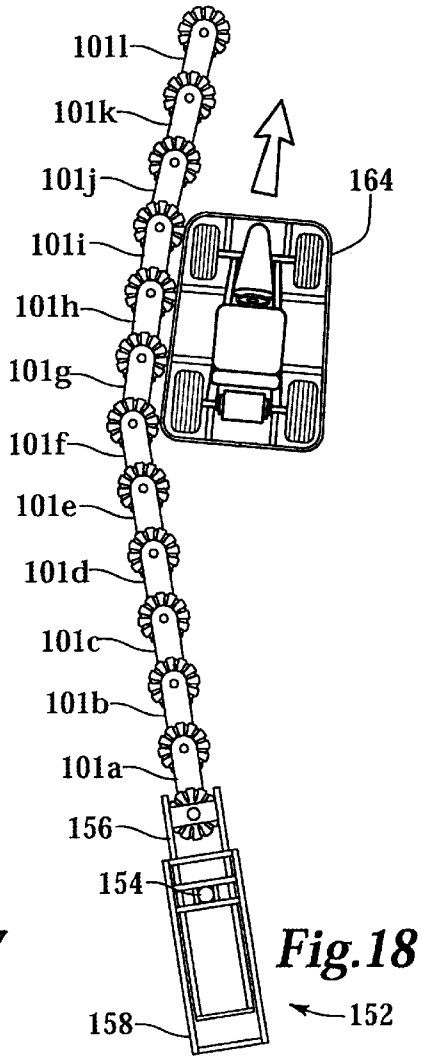
FIG. 18 is a plan view of the barrier chain of FIG. 16 during impact, after the vehicle has been redirected.
Figure 17:
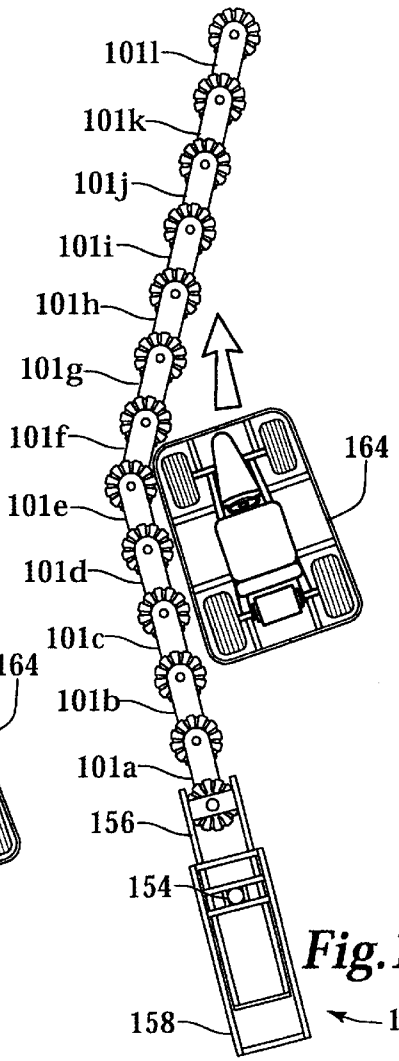
FIG. 17 is a plan view of the barrier chain of FIG. 16 immediately after impact by the vehicle.
Figure 16:
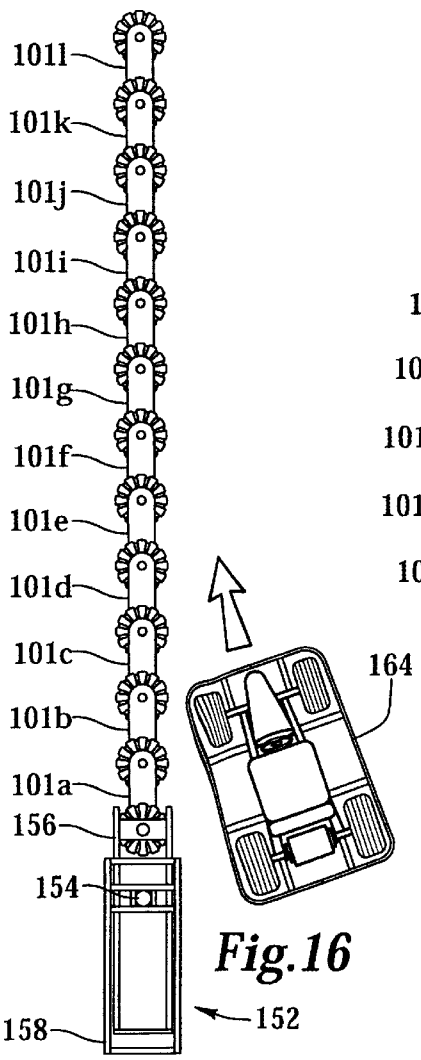
FIG. 16 is a plan view of the barrier chain of FIGS. 14 and 15 arranged along the side of a track of an amusement racing course, immediately before impact by a vehicle.

In the preferred embodiment, the energy absorbing components are a plurality of springs 162 that are connected between the inner and outer cages. As indicated in FIG. 15, the springs generate a return force that resists extension of the inner cage with respect to the outer cage in the direction indicated by arrow 160, which force is in proportion to the distance of the extension. In FIG. 16, the vehicle is approaching a straight barrier chain 100. In FIG. 17, the vehicle has impacted the barrier chain 100 and pushed it laterally. The lateral displacement causes the chain to pull the inner cage 156 from the outer cage 158, against the force generated by springs 162. The extendable energy-absorbing mechanism 152 pivots so that some of the kinetic energy of the vehicle is stored by the springs stretching under a force that acts in a direction parallel to the movement of the inner cage within the outer cage, normal to the post 156. The springs 162 therefore attenuate some of the kinetic energy of the vehicle as the barrier chain is being displaced. In FIG. 18, the barrier chain has redirected the vehicle 164, and the tensioned springs are beginning to pull the barrier back to a fully retracted position, as shown in FIG. 19.

Using springs 162 as energy absorbing components provide certain advantages. They are resilient, and thus the barrier can be easily returned to its original state after an impact. They generate a force roughly proportional to the force of impact: relatively small for low-force impacts and relatively large for large-force impacts. Furthermore, the resistive force generated by the springs is applied gradually, as the barrier chain is increasingly displaced, thus providing a smoother attenuation of the kinetic energy of the vehicle. Finally, the energy stored by the springs can be used to assist with retracting the extendable component of the extendable energy-absorbing mechanism 152, namely inner cage 156, and to returning the barrier chain to at least its approximate position prior to impact. However, other energy absorbing components can be used instead of, or in addition to, springs 162, such as a damper or a sliding mass if these advantages are not desired, or if different force attenuation characteristics are desired for a particular application.

A barrier system according to the present invention has particular advantage when used to line the track of an amusement car racing course. Its modularity provides flexibility for almost any track topography; changes to the track layout are easily accommodated as compared to prior art systems. Furthermore, it can be used to divide a course for side-by-side racing. A fully anchored barrier chain would be typically used along the straight-away sections of the course and along the inside of turns, where an impact of a vehicle is more likely to be glancing and not at an acute angle. Along the outside of a turn, and along a perimeter of a race course, the first barrier module of a barrier chain is connected to an extendable, energy-absorbing mechanism 152 is used, and the last barrier module of the barrier chain is anchored to the ground, the track or a footing.

Figure 20:
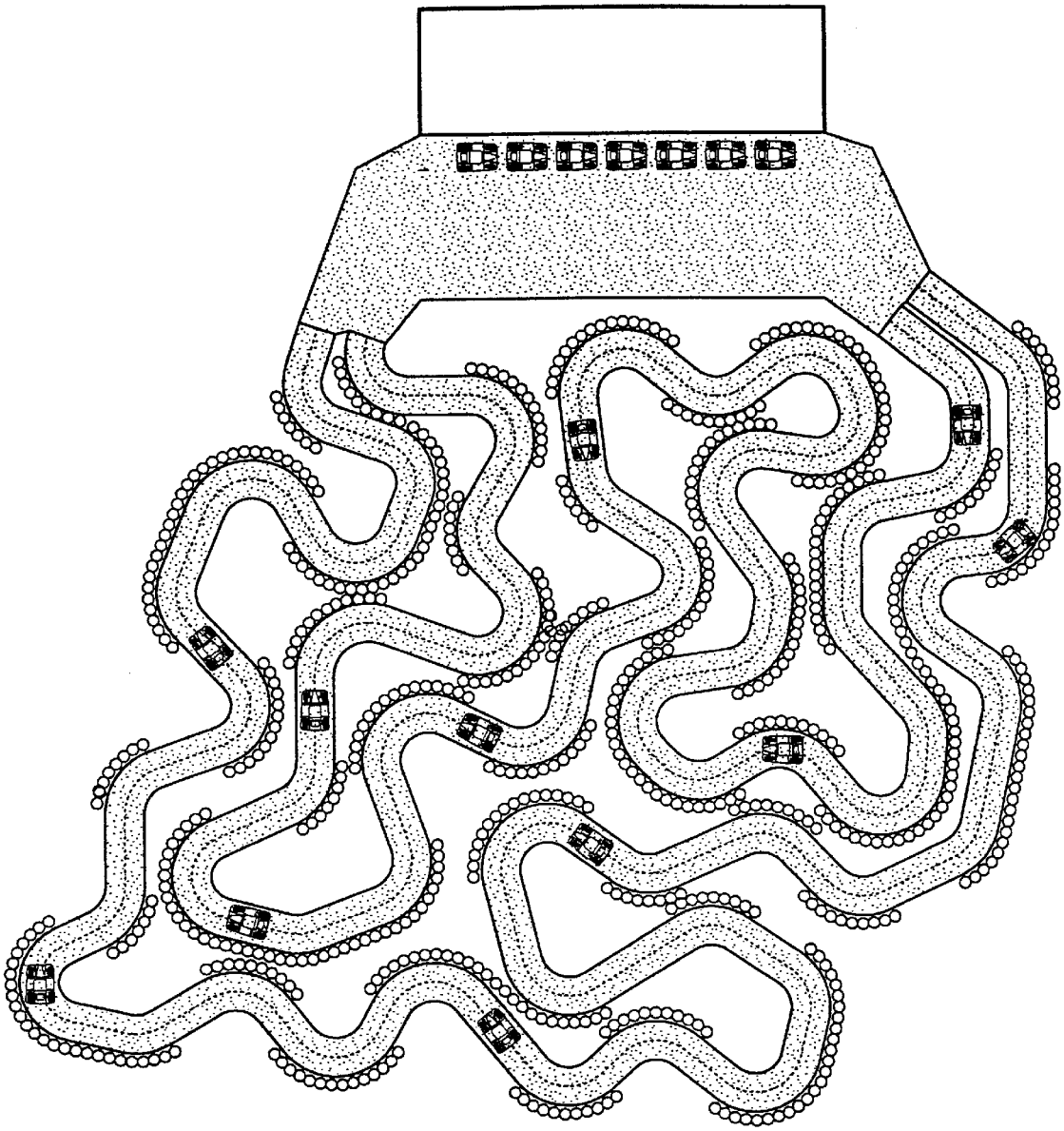
FIG. 20 is a plan view of an amusement race course, having two tracks for side-by-side racing, line with barrier chains.

Referring now to FIG. 20, an representative example of an amusement racing track 166 includes a starting house 168 next to a pit area 170. A plurality of amusement racing cars 172 are illustrated in the pit area and around the track. The track has two courses, an inner course 174 and an outer course 176, for the feel of side-by-side racing. Disposed around the outside corners of each course, along some of the straight-aways and between the tracks are a plurality of barrier chains 100. Some of the barrier chains are anchored at each module. Some are anchored at opposite ends, with end anchored through to a spring cage 152 (not shown) to provide greater resiliency where relatively high-speed impacts or substantially head-on impacts might occur.

A barrier chain according to the present invention can also be adapted for other applications, such as docking areas for boats or other water-based vehicles, though it has special advantages for amusement racing tracks.

The invention has been described in reference to preferred embodiments thereof, which embodiments are intended to illustrate the invention, its various aspects and advantages. However, various changes, substitutions and alterations could be made to such embodiments without departing from spirit and scope of invention as defined by the appended claims.

What is claimed is:

1. A barrier system comprising:

a first barrier module pivotally coupled to a second barrier module, each barrier module including:

a pin;

a substantially hollow barrel comprised of a resilient, deformable material and rotatably journalled on the pin;

an elongated, relatively flat first link having a first and second ends, the first end having defined through it a first opening and the second end having defined through it a second opening, the first link disposed on a first end of the barrel, with the pin extending through the first opening;

an elongated, relatively flat second link having first and second ends, the first end having defined through it a first opening and the second end having defined through it a second opening, the second link disposed on a second end the barrel opposite the first link, with the pin extending through the first opening; and a spacer extending between the first and second links and joining each of the first and second links substantially midway between the respective first and second openings of each such link;

wherein the second end of the first link of the first barrier module overlaps the first end of the first link of the second barrier module, and the pin of the second barrier module extends through the second opening of the first link of the first barrier module; and the second end of the second link of the first barrier module overlaps the first end of the second link of the second barrier module, and the pin of the second barrier module extends through the second opening of the second link of the first barrier module.

2. The barrier system of claim 1 wherein the spacer of the respective first and second barrier modules is integrally formed as a unitary member with the first link of such barrier module, and the second link of such barrier module mechanically cooperates with the spacer to prevent lateral movement of the second link relative to the first link and spacer.

3. The barrier system of claim 1 wherein the barrel of each of the first and second barrier modules has a fluted side wall.

4. The barrier system of claim 1 wherein the barrel of each of the first and second barrier modules has a tapered side wall.

5. The barrier system of claim 1 wherein the pin of at least either the first or second barrier module includes a portion extending beyond the module or anchoring the module to a fixed object.

6. The barrier system of claim 1 wherein one of the first and second modules is connected to an extendable, energy-absorbing mechanism anchored to the ground.

7. The barrier system of claim 6 wherein the extendable energy-absorbing mechanism is pivotally anchored to the ground.

8. The barrier system of claim 6 wherein the extendable energy-absorbing mechanism includes, an outer cage anchored to the ground, an inner cage slidably mounted within the outer cage between a retracted position and an extended position, and energy absorbing components coupled between the inner cage and the outer cage for accommodating movement of the inner cage from the retracted to the extended position and absorbing energy during extension of the inner cage.

9. The barrier system of claim 8 wherein the energy absorbing components include springs.

10. An amusement racing track comprising:

a motor vehicle track;

a barrier chain disposed along at least a portion of the track, the barrier chain including first and second pivotally coupled barrier modules, each barrier module including:

a pin;

a substantially hollow barrel comprised of a resilient, deformable material and rotatably journalled on the pin;

an elongated, relatively flat first link having a first and second ends, the first end having defined through it a first opening and the second end having defined through it a second opening, the first link disposed on a first end of the barrel, with the pin extending through the first opening;

an elongated, relatively flat second link having first and second ends, the first end having defined through it a first opening and the second end having defined through it a second opening, the second link disposed on a second end the barrel opposite the first link, with the pin extending through the first opening; and a spacer extending between the first and second links and joining each of the first and second links substantially midway between the respective first and second openings of each such link;

wherein the second end of the first link of the first barrier module overlaps the first end of the first link of the second barrier module, and the pin of the second barrier module extends through the second opening of the first link of the first barrier module, and the second end of the second link of the first barrier module overlaps the first end of the second link of the second barrier module, and the pin of the second barrier module extends through the second opening of the second link of the first barrier module.

11. The amusement racing track of claim 10 wherein the pin of at least either the first or second barrier module includes a portion extending beyond the module for anchoring the module to a fixed object.

12. The amusement racing track of claim 10 wherein one of the first and second modules is connected to an extendable, energy-absorbing mechanism anchored to the ground.

13. The amusement racing track of claim 12 wherein the extendable energy-absorbing mechanism is pivotally anchored to the ground.

14. The amusement racing track of claim 12 wherein the extendable energy-absorbing mechanism includes, an outer cage anchored to the ground, an inner cage slidably mounted within the outer cage between a retracted position and an extended position, and energy absorbing components coupled between the inner cage and the outer cage for accommodating movement of the inner cage from the retracted to the extended position and absorbing energy during extension of the inner cage.

15. The amusement racing track claim 16 wherein the energy absorbing components include springs.

* * * * *